US006458450B1

(12) United States Patent
Steinhardt et al.

(10) Patent No.: US 6,458,450 B1
(45) Date of Patent: Oct. 1, 2002

(54) TISSUE PAPER

(75) Inventors: Mark John Steinhardt, Cincinnati, OH (US); Michael William Tafuri, Jr., Cincinnati, OH (US); Paul Thomas Weisman, Cincinnati, OH (US); Thomas Hoerner, Hofheim/Taunus (DE); Bernhard Maier, Suzlbach (DE); Paul Dennis Trokhan, Hamilton, OH (US); Kenneth Douglas Vinson, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 119 days.

(21) Appl. No.: 09/638,096

(22) Filed: Aug. 11, 2000

Related U.S. Application Data

(63) Continuation of application No. 09/246,382, filed on Feb. 9, 1999.

(51) Int. Cl.[7] ..... B32B 29/00; B32B 3/00; B32B 7/00

(52) U.S. Cl. ..... 428/211; 428/219; 428/220; 428/332; 428/340; 162/100

(58) Field of Search ..... 428/211, 141, 428/219, 220, 332, 340; 162/100

(56) References Cited

U.S. PATENT DOCUMENTS

| | | | | | |
|---|---|---|---|---|---|
| 3,301,746 | A | | 1/1967 | Sanford et al. | 162/113 |
| 4,171,047 | A | | 10/1979 | Doyle et al. | 206/210 |
| 4,191,609 | A | | 3/1980 | Trokhan | 162/113 |
| 4,300,981 | A | | 11/1981 | Carstens | 162/109 |
| 4,514,345 | A | | 4/1985 | Johnson et al. | 264/22 |
| 4,529,480 | A | | 7/1985 | Trokhan | 162/109 |
| 4,610,678 | A | * | 9/1986 | Weisman et al. | 604/368 |
| 4,637,859 | A | | 1/1987 | Trokhan | 162/109 |
| 4,654,039 | A | * | 3/1987 | Brandt et al. | 604/368 |
| 4,687,153 | A | * | 8/1987 | McNeil | 242/56.8 |
| 4,826,499 | A | * | 5/1989 | Ahr | 604/389 |
| 4,834,735 | A | * | 5/1989 | Alemany et al. | 604/368 |
| 4,981,557 | A | | 1/1991 | Bjorkquist | 162/168.2 |
| 5,098,522 | A | | 3/1992 | Smurkoski et al. | 162/358 |
| 5,114,771 | A | * | 5/1992 | Ogg et al. | 428/43 |
| 5,143,776 | A | * | 9/1992 | Givens | 428/198 |
| 5,223,096 | A | * | 6/1993 | Phan et al. | 162/158 |
| 5,240,562 | A | * | 8/1993 | Phan et al. | 162/158 |
| 5,245,025 | A | | 9/1993 | Trokhan et al. | 536/56 |
| 5,260,171 | A | | 11/1993 | Smurkoski et al. | 430/320 |
| 5,275,700 | A | | 1/1994 | Trokhan | 162/358.1 |
| 5,364,504 | A | | 11/1994 | Smurkoski et al. | 162/116 |
| 5,534,326 | A | | 7/1996 | Trokhan et al. | 428/131 |
| 5,549,790 | A | | 8/1996 | Van Phan | 162/109 |
| 5,554,467 | A | | 9/1996 | Trokhan et al. | 430/11 |
| 5,556,509 | A | | 9/1996 | Trokhan et al. | 162/111 |
| 5,566,724 | A | | 10/1996 | Trokhan et al. | 139/383 |
| 5,609,269 | A | | 3/1997 | Behnke et al. | 221/48 |
| 5,611,890 | A | * | 3/1997 | Vinson et al. | 162/111 |
| 5,656,746 | A | | 8/1997 | Smith et al. | 536/63 |
| 5,679,222 | A | | 10/1997 | Rasch et al. | 162/358.1 |
| 5,698,688 | A | | 12/1997 | Smith et al. | 536/56 |
| 5,820,730 | A | | 10/1998 | Phan et al. | 162/112 |
| 5,837,103 | A | | 11/1998 | Trokhan et al. | 162/358.2 |
| 5,846,379 | A | | 12/1998 | Ampulski et al. | 162/109 |
| 5,851,352 | A | * | 12/1998 | Vinson et al. | 162/112 |
| 5,855,738 | A | * | 1/1999 | Weisman et al. | 162/113 |
| 5,858,292 | A | * | 1/1999 | Dragoo et al. | 264/115 |
| 5,921,977 | A | * | 7/1999 | Schmitz | 604/391 |
| 5,972,456 | A | | 10/1999 | Esquivel | 428/43 |
| 5,980,691 | A | * | 11/1999 | Weisman et al. | 162/117 |
| 6,059,928 | A | * | 5/2000 | Van Luu et al. | 162/111 |
| 6,265,052 | B1 | * | 7/2001 | Steinhardt et al. | 428/211 |

FOREIGN PATENT DOCUMENTS

| | | |
|---|---|---|
| WO | WO 98/47419 | 10/1998 |

* cited by examiner

*Primary Examiner*—Cynthia H. Kelly
*Assistant Examiner*—B. Shewareged
(74) *Attorney, Agent, or Firm*—Larry L. Huston; David K. Mattheis; David M. Weirich

(57) ABSTRACT

A wiping implement suitable for use as a bath tissue can be formed into sheets, each sheet comprising at least one ply of a paper web having a basis weight of at least about 25 lb/3000 square feet. The sheet can have a width of at least about 4.5 inches and temporary wet tensile properties. The sheet of the present invention can have an area of at least about 30 square inches. In a multiple ply embodiment, the sheet can have an optimized basis weight of at least about 42 lb/3000 square feet while maintaining nearly the same amount of actual total fiber usage per cleaning task as current premium bath tissues.

2 Claims, 2 Drawing Sheets

TISSUE PAPER

This is a continuation of application Ser. No. 09/246,382, filed Feb. 9, 1999.

FIELD OF THE INVENTION

The present invention relates to strong, soft, absorbent paper webs, and to the processes for making them.

BACKGROUND OF THE INVENTION

One pervasive feature of daily life in modern industrialized societies is the use of disposable products, particularly disposable products made of paper. Paper towels, facial tissues, bath tissues, and the like are in almost constant use. The general demand for disposable paper products has created a demand for improved versions of the products and of the methods of their manufacture. Despite great strides in paper making, research and development efforts continue to be aimed at improving both the products and their processes of manufacture.

Disposable products such as paper towels, facial tissues, bath tissues, and the like are made from one or more plies of tissue paper. If the products are to perform their intended tasks and to find wide acceptance, they, and the tissue paper webs from which they are made, must exhibit certain physical characteristics. Among the more important of these characteristics are strength, softness, and absorbency.

Strength is the ability of a paper web to retain its physical integrity during its intended use.

Softness is the pleasing tactile sensation the user perceives as he or she crumples the paper in his or her hand and contacts various portions of his or her anatomy with it.

Absorbency is the characteristic of the paper which allows it to take up and retain fluids, particularly water, aqueous solutions and suspensions.

In addition to strength, softness, and absorbency, bath tissue (i.e., toilet paper) should have sufficient physical properties to allow cleaning tasks to be performed efficiently. By "cleaning task" is primarily meant post toilet cleaning, i.e., post-urination or post-defecation wiping. By "efficiently" is meant that cleaning is accomplished with a minimal waste of paper and preferably with no soiling of the hands of the user. Additionally, the user should perceive the post cleaning state as clean, dry, and fresh.

Current bath tissues are generally thin, i.e., they have relatively low caliper. Even with recent improvements in tissue bulk, basis weight, and caliper, consumers typically use multiple layers of bath tissue by folding or crumpling tissue for each cleaning task. Multiple layers may be necessary to prevent poke through of fingers, as well as to prevent moisture from contacting the user's hands. Often more paper than necessary is pulled from a roll due to the consumer's desire to minimize the risk of soiling his or her hands during cleaning. Thus, cleaning efficiency is sacrificed due to the real and perceived needs of the user.

Whereas most consumers feel the need to use many layers of current bath tissue to provide adequate cleaning with hand protection, most consumers also desire to minimize waste, and use less disposable paper. The reasons for this are varied, but include an innate desire to conserve resources, minimize cost, preserve the environment, or combinations of these reasons. For example, the recent introduction by The Procter & Gamble Co. of BOUNTY® "Select-a-Size™" paper towels and BOUNTY® "Rinse and Reuse™" paper towels are an attempt to address this problem in the category of paper towels. However, the problem has yet to be adequately addressed in the category of bath tissue.

Accordingly, it would be desirable to have a wiping article that provides for more efficient post toilet cleaning.

Additionally, it would be desirable to have a bath tissue that allows consumers to use less bath tissue for each cleaning task, while maintaining adequate hand protection.

Further, it would be desirable to provide a strong, soft, absorbent tissue paper being able to provide superior cleaning, even one sheet cleaning, without the need to fold or crumple the paper prior to use.

SUMMARY OF THE INVENTION

A wiping implement suitable for use as a bath tissue can be formed into sheets, each sheet comprising at least one ply of a paper web having a basis weight of at least about 25 lb/3000 square feet. The sheet can have a width of at least about 4.5 inches and temporary wet tensile properties. The sheet of the present invention can have an area of at least about 30 square inches. In a multiple ply embodiment, the sheet can have an optimized basis weight of at least about 42 lb/3000 square feet while maintaining nearly the same amount of actual total fiber usage per cleaning task as current premium bath tissues.

DETAILED DESCRIPTION OF THE INVENTION

Figure 1:
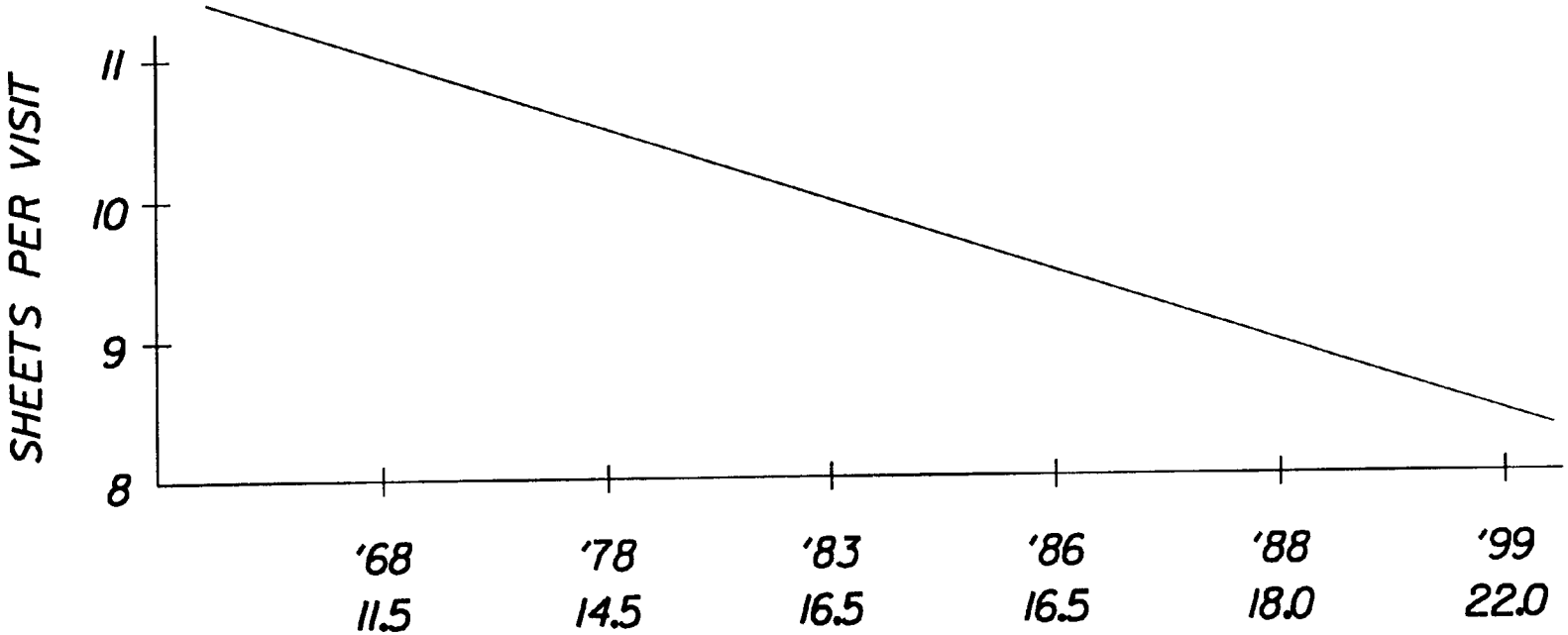
FIG. 1 is a schematic historical graph of the relationship between basis weight of single ply dry paper and the average number of sheets per cleaning task.

The present invention provides an improved paper web suitable for use as a bath tissue providing for effective cleaning with as good or better cleaning efficiency in relation to currently available bath tissues. Generally speaking, the improvement is accomplished by providing a tissue having a relatively high basis weight and increased area relative to current bath tissue. This approach is contrary to the conventional belief that increasing basis weight and area would significantly increase the amount of tissue used per cleaning task. The present invention is based upon the discovery that reduced consumption of tissue paper, and even one-sheet cleaning, can be accomplished by a wiping article of the present invention, in particular a bath tissue, having the combination of properties disclosed herein.

As used herein, the term "area" refers to the projected two dimensional surface area of a flat paper web, and in particular, refers to the area of a single sheet of paper web useful as a bath tissue wiping article of the present invention.

As used herein "sheet" refers to a single, distinct paper web of the wiping article of the present invention. For example, each sheet may be discrete, and provided in a stacked configuration with similar sheets. Stacked sheets may be folded and interleaved, such as is common with facial tissues, for example. Sheets may also be provided on a roll, with individual sheets being defined by perforations repeated at predetermined intervals, as commonly used with bath tissues.

As used herein, the term "width" refers to the lesser of two area dimensions of a single sheet of paper web in a generally rectangular shape. A generally square or rectangular shaped wiping article is contemplated as a preferred configuration, but other shapes such as circles, ellipses, etc., may be useful as well. In general, for core-wound product of sheets defined by perforations, the sheet will have a dimension parallel to the perforations, and a dimension perpendicular to the perforations. Thus, the dimension of a sheet that is parallel to the perforations is generally equal to the width of a core-wound roll of sheets (i.e., generally equal to the axial length of the core of the core wound roll). Further, the web of the present invention may be beneficially folded prior to core winding to provide for a sheet having an unfolded width dimension greater than the length of the core of the core wound roll.

As used herein, "cleaning efficiency" refers to an average measure of paper used per visit, or per cleaning task. As used herein "cleaning task" refers primarily to a single occurrence of post toilet cleaning, i.e., post-urination or post-defecation wiping. It is recognized that all cleaning tasks are not equal with regard to paper usage or the amount of paper required. For example, users typically pull off an amount of toilet paper perceived by the user to be sufficient to perform post-toilet cleaning without soiling the fingers or hand of the user. This amount differs from person to person, particularly among female users. Yet by improving the cleaning efficiency of the paper web, a paper web of the present invention can permit the user to use less paper per any given cleaning task, which can result in significantly less average paper usage.

FIG. 1 illustrates the need for an improvement in cleaning efficiency. FIG. 1 is a graph showing the relationship over approximately thirty years of development between the basis weight of single ply dry paper and the average number of sheets used per cleaning task. Steady development in papermaking technology and consumer understanding from the late 1960's to the present has produced paper webs having increasing basis weight. Consumer usage testing during this period indicates that the number of sheets per cleaning task has steadily declined accordingly. However, there is actually an increase in the total amount of paper used per cleaning task. For example, in 1968, for 4.5 inch square sheets, approximately 0.0062 pounds of paper were used per cleaning task, while in 1999, for the same area per sheet, approximately 0.0085 pounds of paper were used per cleaning task.

In addition to the desire to improve cleaning efficiency to use less paper per cleaning task, cleaning efficiency relates to the consumer's experience in performing cleaning tasks. For example, better cleaning efficiency can result in faster cleaning, and/or more thorough cleaning with fewer pulls of tissue from a roll. Thus, the improvements of the present invention can result in more thorough cleaning, which is important in consumer's perceptions of being "fresh" and dry after cleaning. Further, the improvements of the present invention can result in an equal perception of clean, in a format, i.e., paper size and structure, that promotes efficient cleaning. Although not easily quantified, improving the overall consumer experience is extremely important for successfully commercializing a bath tissue product.

While having a relatively high basis weight is important to the wiping article of the present invention, the overall area of the wiping article is important as well. Therefore, it is believed that certain minimum dimensions and areas are necessary to permit successful post toilet cleaning, particularly if one sheet cleaning is desired. For example, it is believed that the width of the wiping article should not be less than the width of the user's hand, which practically can be considered to be about 4.5 inches. Widths less than about 4.5 inches could force the user to use multiple wraps, folds, or bunches of paper to perform the cleaning task, thereby defeating any possibly efficiency gains. It is also believed that a wiping article having a width greater than about 9 inches would become unwieldy in the hand of most users, and would likewise necessitate folding, bunching, or crumpling to be effective.

Because of the very personal and sensitive nature of post toilet cleaning, usage data is typically indirectly generated. One widely used method of determining consumer usage data is to conduct diary studies. In a diary study a user records usage for individual cleaning tasks over a period of time and the results are compared and analyzed. Another method of determining usage that is more accurate involves modifying the users toilet paper roll, such that usage is automatically monitored and recorded over a period of time. The information can be accessed and analyzed, thereby providing very accurate use data. The data shown in FIG. 1, for example were generated by both of the above-mentioned methods. Another method for relatively quickly gauging consumer usage is to conduct a focus group in which a panel of consumers is presented with one or more samples of paper and queried as to amount and method of use each may perceive as necessary for a given task.

In Table 1 below, use data are shown for three commercial bath tissues. For each bath tissue, use data by two of the above-mentioned methods is shown. The historical data for focus group panelists is typically lower than actual in-home recorded use, and a percentage differential is shown. For each tissue, a Total Usage parameter is calculated, based on sheet sizes of 4×4.5 inches for each. Total Usage in Table 1 is a measure of actual weight of paper per post urinary drying task, and is calculated as follows:

$$\text{Total Usage}=BW*A*N$$

where:

BW=basis weight (lb/3000 $ft^2$)

A=Area of one sheet ($ft^2$)

N=Number of sheets

TABLE 1

Comparison of Use Data for Three Bath Tissues

| Paper Type | Basis Weight (lb/3000 sq. ft) | Number of Sheets per Task (In Home Recorder) | Number of Sheets per Task (Focus Group) | % Diff. | Usage Units (lbs.) |
|---|---|---|---|---|---|
| Scott 1000 ® | 12 | 12 | 9 | 75 | 0.0045 |
| CHARMIN ® 1-ply | 18 | 8.9 | 7.4 | 85 | 0.0056 |
| CHARMIN ® Ultra | 24 | 7.4 | 6.3 (est.) | 85 | 0.0063 (est.) |

CHARMIN® Ultra bath tissue, marketed by The Procter & Gamble Co. of Cincinnati, Ohio is considered to be a premium toilet tissue. As such, CHARMIN Ultra bath tissue provides the user with a very high degree of strength, softness, absorbency, and other physical properties necessary to provide adequate cleaning with a high degree of overall satisfaction. The CHARMIN Ultra bath tissue consumer's superior cleaning experience is difficult to quantify, but is evidenced by the commercial success and customer satisfaction with CHARMIN Ultra bath tissue. Therefore, it is believed that consumer expectations of premium bath tissue provide a sufficient baseline for further improvements.

Based on this understanding, it is believed that a bath tissue providing consumer satisfaction with a total usage of between about 0.0060 and 0.0070 lbs per post urinary drying cleaning task is as efficient as current commercial CHARMIN Ultra bath tissue. The bath tissue of the present invention provides for this level of efficiency in a higher basis weight product. Additionally, the bath tissue of the present invention can provide improved efficiency in a higher basis weight product. Finally, while possibly not being quite as efficient as current commercial CHARMIN Ultra bath tissue, the bath tissue of the present invention can provide for a strong, soft, absorbent tissue paper able to provide high cleaning satisfaction, even one sheet cleaning for post bowel movement cleaning, with very nearly the efficiency of CHARMIN Ultra bath tissue.

In general, it has been found that a sheet having a width of at least about 4.5 inches and a minimum area of at least about 30 square inches, at a basis weight of at least about 25 lbs/3000 sq. ft. can permit the user to perform cleaning tasks, often with one sheet, while maintaining close to the level of cleaning efficiency and adequate hand protection experienced by premium bath tissue users. For use as a toilet tissue, it is important that the tissue be flushable. That is, it is important that the tissue be degradable in water to a sufficient degree that plumbing remains operable. Additionally, for the tissue of the present invention, it is preferable that the tissue have temporary wet strength, thereby permitting the user the option of wetting the tissue prior to use. Temporary wet strength allows the tissue to maintain structural integrity for the cleaning task, but allows the tissue to degrade when flushed. These and other beneficial properties of a bath tissue of the present invention are more fully disclosed below.

Table 2 below shows the results of focus group testing of various embodiments of bath tissues of the present invention. The compiled results are averages from two focus groups of eight panelists each. In both groups the panelists were women who were asked to pull off from rolls of sample product the amount of tissue believed necessary for post urinary drying. The sample products were each two ply bath tissues provided in three different product widths, and each at three different total basis weights. In all other respects, e.g., sheet length (between perforations), softness, texture, visual appearance, the sample products were similar.

TABLE 2

Total Usage for Embodiments of the Present Invention

| No. | B.W. (lb/ 3K ft$^2$) | Width per Sheet (in) | Area per Sheet (in$^2$) | No. of Sheets | Total Usage (lbs) |
|---|---|---|---|---|---|
| 1 | 28 | 4.5 | 0.25 | 3.1 | 0.0072 |
| 2 | 28 | 5.75 | 0.32 | 2.6 | 0.0078 |
| 3 | 28 | 7.0 | 0.39 | 1.8 | 0.0065 |
| 4 | 44 | 4.5 | 0.25 | 2.6 | 0.0095 |
| 5 | 44 | 5.75 | 0.32 | 2.0 | 0.0094 |
| 6 | 44 | 7.0 | 0.39 | 1.6 | 0.0091 |
| 7 | 70 | 4.5 | 0.25 | 1.9 | 0.0111 |
| 8 | 70 | 5.75 | 0.32 | 1.8 | 0.0134 |
| 9 | 70 | 7.0 | 0.39 | 1.5 | 0.0136 |

Without being bound by theory it is believed that the primary signal to users as to the effectiveness of bath tissue is caliper. Thus, as caliper increases, the user's sensory perception of effective cleaning and adequate hand protection increases. Again, without being bound by theory, it is believed that the caliper provides the user with a sense of distance from the subject area of cleaning, which provides for confident cleaning without having to intimately feel the area being cleaned.

Thus, it is believed that the caliper of the above sampled embodiments of the present invention was a significant user stimulus for determining the amount of tissue perceived as necessary for post urinary drying. If caliper could be maintained while simultaneously reducing basis weight, the result would be a decrease in actual fiber usage without an accompanying decrease in consumer satisfaction. Therefore, as discussed below, one aspect of the present invention lies in optimizing the density of the bath tissue of the present invention while retaining the caliper of the samples tested above. In other words, by decreasing the density of the bath tissue, while keeping the equivalent caliper of the samples tested above, the basis weight of the bath tissue is reduced, which results in less fiber usage.

The bath tissue embodiments tested in the focus group were through air dried paper made using papermaking belts in papermaking processes as described below. However, the bath tissue embodiments tested were not optimized for optimum fiber content. Thus, for identical caliper generation, bath tissues made by the processes described below can have very different densities, and thus very different basis weights. For example, the 70 lb/3000 ft$^2$ embodiment can be optimized by reducing the density (and therefore the basis weight) by as much as 40% (i.e., 60% optimization) while maintaining constant caliper. Likewise, the density of the 44 lb/3000 ft$^2$ and 28 lb/3000 ft$^2$ embodiments can be reduced by as much as 20% and 10%, respectively.

Without being restricted to a particular method of optimizing density of high basis weight paper webs, the following disclosure teaches methods which may be employed to optimize density of creped papermaking webs employing paper machine clothing of the type disclosed in U.S. Pat. No. 4,529,480, issued on Jul. 16, 1985 and hereby incorporated herein by reference. This method is described in detail below. In broad terms, the density of such a paper web is a function of its basis weight and its resultant caliper. The caliper is itself a function of basis weight and also of the size, shape, and depth of the deflection conduits formed by the hardened photosensitive resin framework described in the '480 patent and its progeny.

Optimization of caliper of such a papermaking web at a given basis weight can be carried out by taking the following steps in turn.

1. Change the depth of the deflection conduits. For a given conduit size and shape, there will exist an optimum conduit depth. Conduits of insufficient depth will resist the deflecting web before it has fully extended. By contrast, conduits which are excessive in depth will not provide sufficient support for the web and can permit localized pinholing at the point of maximum deflection, thus removing the motive force for deflection prior to reaching maximum caliper potential.
2. Change the size of the deflection conduits. For a given conduit depth and shape, there will exist an optimum conduit size. Conduits of insufficient size will not allow the deflecting web to fully extend. By contrast, conduits which are excessive in size will not provide sufficient support for the web and can permit localized pinholing at the point of maximum deflection, thus removing the motive force for deflection prior to reaching maximum caliper potential.
3. Change the shape of the deflection conduits. Deflection conduits made according to commonly assigned U.S.

Pat. No. 5,679,222 issued Oct. 21, 1997 in the name of Rasch et al., and hereby incorporated herein by reference overcome limitations of prior art conduit shapes providing for higher levels of caliper potential.

Those skilled in the art of structured papermaking will recognize that size, shape, and depth of conduits are interrelated as they impact caliper potential at a given basis weight. Therefore, in general, optimization of caliper is an iterative process through which each factor is optimized in turn until a solution is reached which provides the sought-after level of caliper.

Those skilled in the art will further recognize that there are other factors which determine the caliper and thus the density of a papermaking web. These include such factors as the average fiber length of the furnish; the coarseness of the papermaking fibers; the quality of the formation or uniformity of the web; and process factors including in particular the vacuum levels used in papermaking and the geometry of the creping blade in relation to the Yankee dryer, the speed of the papermaking web, and the degree of foreshortening of the web, sometimes referred to as the % crepe.

Table 2 is reproduced as Table 3 below, showing the results of optimizing the papermaking process to produce the bath tissue embodiments shown in Table 2 having equivalent caliper at the reduced densities cited above.

TABLE 3

Optimized Total Usage for Embodiments of the Present Invention

| No. | Optimized B.W. (lb/ 3 Kft$^2$) | Width per Sheet (in) | Area per Sheet (in$^2$) | No. of Sheets | Total Usage (lbs) | % Optimization | Optimized Total Usage |
|---|---|---|---|---|---|---|---|
| 1 | 25 | 4.5 | 0.25 | 3.1 | 0.0072 | 90 | 0.0065 |
| 2 | 25 | 5.75 | 0.32 | 2.6 | 0.0078 | 90 | 0.0070 |
| 3 | 25 | 7.0 | 0.39 | 1.8 | 0.0065 | 90 | 0.0058 |
| 4 | 35 | 4.5 | 0.25 | 2.6 | 0.0095 | 80 | 0.0076 |
| 5 | 35 | 5.75 | 0.32 | 2.0 | 0.0094 | 80 | 0.0075 |
| 6 | 35 | 7.0 | 0.39 | 1.6 | 0.0091 | 80 | 0.0073 |
| 7 | 42 | 4.5 | 0.25 | 1.9 | 0.0111 | 60 | 0.0067 |
| 8 | 42 | 5.75 | 0.32 | 1.8 | 0.0134 | 60 | 0.0080 |
| 9 | 42 | 7.0 | 0.39 | 1.5 | 0.0136 | 60 | 0.0082 |

As shown in Table 3, the bath tissues of the present invention, having been optimized for density, can provide for efficient post toilet cleaning (in this example, post urinary cleaning) near or below the total usage levels experienced with current commercial premium bath tissues. Additionally, the increased area presented to the consumer by the increased width of bath tissues of the present invention signals increased cleaning ability, as well as increased coverage of the user's hand. These attributes are important in assuring the user that sufficient cleaning can take place with adequate, and preferably complete, hand protection. Further, by providing a high surface area, high basis weight wiping implement, it is believed that many users will change their wiping habits, thereby contributing further to the efficiency of the bath tissue of the present invention. For example, many users who normally crumple, wad, or bunch bath tissue will find that the bath tissue of the present invention can be effectively used when flat, thereby using significantly less total fibers per cleaning task.

Because flexibility is related to consumer's perception of softness in a bath tissue, it is important that the wiping article of the present invention have good flexibility. Without quantifying the necessary flexibility, it is known that having multiple plies in a tissue product improves the flexibility over a single ply of equivalent basis weight, and therefore it improves the perceived softness of the article. Therefore, although the preferred basis weight of a wiping article of the present invention may be achieved in a single ply, it is preferably achieved by combining multiple plies, as taught in commonly assigned U.S. Pat. No. 5,143,776, issued Sep. 1, 1992 to Givens which is hereby incorporated herein by reference.

Because the tissue of the present invention is preferably a bath tissue, it is important for commercial success that the paper web of the article have certain wet strength properties. At a minimum the web should be flushable, that is, it should have temporary wet strength, so that in use it retains strength properties, but once deposited into the toilet it readily breaks up to prevent clogging of sewer systems. Therefore, it is important for the sheet of the present invention to have temporary wet strength. As used herein in relation to bath tissues, "temporary wet strength" means that the paper retains sufficient physical integrity for cleaning tasks, but decays sufficiently in the toilet for flushing without clogging sewer systems. Temporary wet strength can be achieved by the addition of suitable wet strength resins during papermaking, such as disclosed in commonly assigned U.S. Pat. No. 4,981,557, issued Jan. 1, 1991 to Bjorkquist, and hereby incorporated herein by reference.

Many users prefer to perform post toilet cleaning tasks with wetted tissue. Therefore, in a preferred embodiment, the bath tissue sheet of the present invention has sufficient temporary wet strength such that it can be used in a wetted condition if desired. For example, the bath tissue of the present invention can be supplied on core wound rolls (typical of current bath tissue) and dispensed from tissue dispensers fitted with wetting surfaces. The user can pull the tissue sheet over the wetting surface, or "dab" the surface as desired. Once wetted, the user performs the cleaning task to his or her satisfaction, and discards the tissue into the toilet. Due to the wet condition of the paper substrate under such conditions, the high basis weight of the present invention is very beneficial in preventing undesired finger poke through, or premature loss of integrity of the paper structure.

Therefore, in a preferred embodiment, the bath tissue sheet of the present invention enables use of the product in the moistened condition, but exhibits a suitable wet strength decay rate after being disposed in the toilet to prevent stoppage of toilet plumbing. Commonly assigned U.S. Pat. No. 5,656,746, issued Aug. 12, 1887 to Smith is hereby incorporated herein by reference, which patent discloses a wet strength polymer that provides paper products with an initial wet strength that enables use of the product in the moistened condition, along with a suitable wet strength decay rate. The rate of temporary wet strength decay can be varied as desired by, for example, adjusting the amount of temporary wet strength polymer applied to the paper web during paper manufacture.

Preferably, the paper product of the present invention has an initial wet tensile strength of at least about 80 g/inch, more preferably at least about 120 g/inch. Moreover, it is desirable for tissue paper products to exhibit a wet strength decay rate such that it can be flushed without a significant risk of sewer system clogging. Preferred products have a total wet tensile strength after 30 minutes of soaking in neutral pH water of less than about 40 g/in, preferably less than about 20 g/inch. Flushable paper products may exhibit a wet strength decay rate after 30 minutes of soaking in neutral pH water of at least about 70%, preferably at least about 80%.

Treatment of the paper web of the present invention with the temporary wet strength polymer may involve spraying or printing the cellulosic fibers that have been substantially set in the preparation of the paper product, e.g., by a wet laid process. The set fibers are preferably sprayed or printed with the temporary wet strength polymer in the form of a temporary wet strength composition which comprises a fluid mixture of a wet strength polymer substantially dissolved in a suitable solvent. Water is the preferred solvent. The fluid mixture typically contains from about 1–10 weight % of the polymer and about 90–99 weight % of the solvent, for example, a mixture of about 5 weight % of the polymer and about 95 weight % of the solvent, is suitable. In a preferred embodiment, treatment is accomplished by spraying the set fibers. Alternatively, the temporary wet strength polymer is combined with the cellulosic fibers in the wet-end of a wet laid paper-making process. Thus, the temporary wet strength polymer may suitably be included in the paper-making furnish. The mount of temporary wet strength polymer that is combined with the cellulosic fibers is generally selected to provide a balance of initial wet strength, wet tensile decay, and optionally other properties, including dry strength, consistent with the objects of the invention. In general, with increasing mounts of the polymer there is an increase in dry strength and initial wet tensile strength and a decrease in the rate of wet strength decay. The paper products will typically contain from about 0.5 to about 5 weight % of the polymer, based on the weight of the cellulosic fibers and optionally other fibers containing hydroxyl groups. Preferably, the paper products will contain from about 0.5 weight % to about 2 weight % of the polymer, based on the weight of such fibers.

The aforementioned tensile properties may be determined as described as follows:

The paper products are aged prior to tensile testing a minimum of 24 hours in a conditioned room where the temperature is 73° F.+/−4° F. (22.8° C.+/−2.2° C.) and the relative humidity is 50%+/−10%.

1. Total Dry Tensile Strength ("TDT")

This test is performed on one inch by five inch (about 2.5 cm×12.7 cm) strips of paper (including creped tissue paper, handsheets, as well as other paper sheets) in a conditioned room where the temperature is 73° F.+/−4° F. (about 28° C. +/−2.2° C.) and the relative humidity is 50% +/−10%. an electronic tensile tester (model 1122, Instron Corp., Canton, Mass.) is used and operated at a crosshead speed of 2.0 inches per minute (about 1.3 cm per min.) and a gauge length of 4.0 inches (about 10.2. cm). Reference to a machine direction means that the sample being tested is prepared such that the 5" dimension corresponds to that direction. Thus, for a machine direction (MD) TDT, the strips are cut such that the 5" dimension is parallel to the machine direction of manufacture of the paper product. for a cross machine direction (CD) TDT, the strips are cut such that the 5" dimension is parallel to the cross-machine direction of manufacture of the paper product. Machine-direction and cross-machine directions of manufacture are well known terms in the art of papermaking.

The MD and CD tensile strengths are determined using the above equipment and calculations in the conventional manner. The reported value is the arithmetic average of at least eight strips tested for each directional strength. The TDT is the arithmetic total of the MD and CD tensile strengths.

2. Wet Tensile Strength

An electronic tensile tester (Model 1122, Instron Corp.) is used and operated at a crosshead speed of 0.5 inch (about 1.3 cm) per minute and a gauge length of 1.0 inch (about 2.5 cm), using the same size strips as for TDT. The two ends of the strip are placed in the jaws of the machine such and the center of the strip is placed around a stainless steel peg. The strip is soaked in distilled water at about 20° C. for the desired soak time, and then measured for tensile strength as in the case of the TDT, reference to a machine direction means that the sample being tested is prepared such that the 5 inch dimension corresponds to that direction.

The MD and CD wet tensile strengths are determined using the above equipment and calculations in the conventional manner. The reported value is the arithmetic average of at least eight strips tested for each directional strength. The total wet tensile strength for a given soak time is the arithmetic total of the MD and CD tensile strengths for that soak time. initial total wet tensile strength ("ITWT") is measured when the paper has been saturated for 5+/−0.5 seconds. 30 minute total wet tensile ("30 MTWT") is measured when the paper has been saturated for 30+/−0.5 minutes.

3. Wet tensile strength decay rate is defined according to the following equation:

% decay=[(*ITWT*−30 *MTWT* of paper including the temporary wet strength polymer of the invention)×100] divided by: (*ITWT*−30 *MTWT* of comparable paper without any strength additive)

Further examples of temporary wet strength resins and methods useful for the present invention are disclosed in commonly assigned U.S. Pat. No. 5,698,688 issued to Smith; U.S. Pat. No. 5,690,790 issued to Headlam; U.S. Pat. Nos. 5,138,002, 5,008,344, and 5,085,736, each issued to Bjorkquist; each of the aforementioned patents hereby incorporated herein by reference.

Figure 2:
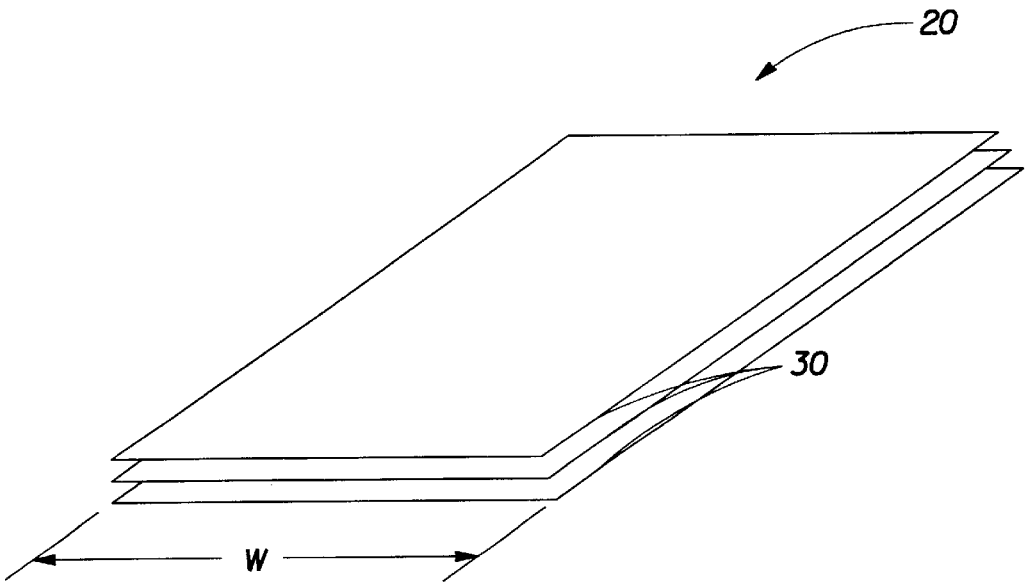
FIG. 2 is a perspective view of a sheet of the present invention.

FIG. 2 illustrates one sheet 20 of a bath tissue of the present invention. Sheet 20 is formed from a paper web made according to one of the methods described herein. Sheet 20 has a first surface and an oppositely facing second surface and can comprise from 1 to 4 or more plies 30, the sheet having a total basis weight (i.e., total of all the component plies) of at least about 25 lb/3000 sq. ft. A width W of at least 4.5 inches and an area of at least about 30 sq. in. helps to assure adequate hand coverage during cleaning tasks. The wet tensile properties can be designed such that the tissue can be used wet if desired, yet remain flushable.

Sheet 20 can have higher basis weights than 25 lb/3000 sq. ft. Such higher basis weight can be beneficial in delivering to consumer confidence in the cleaning ability of the sheet, particularly when used for one sheet cleaning. For example, the basis weight can be at least 28 lb/3000 sq. ft., and is preferably optimized at 35 lb/3000 sq. ft., and more preferably optimized at about 42 lb/3000 sq. ft., and even more preferably is at least about 70 lb/3000 sq. ft. and even as high as 100 lb/3000 sq. ft. In all cases, fiber efficiency is provided for by optimizing the density of the paper web by methods disclosed herein.

Figure 3:
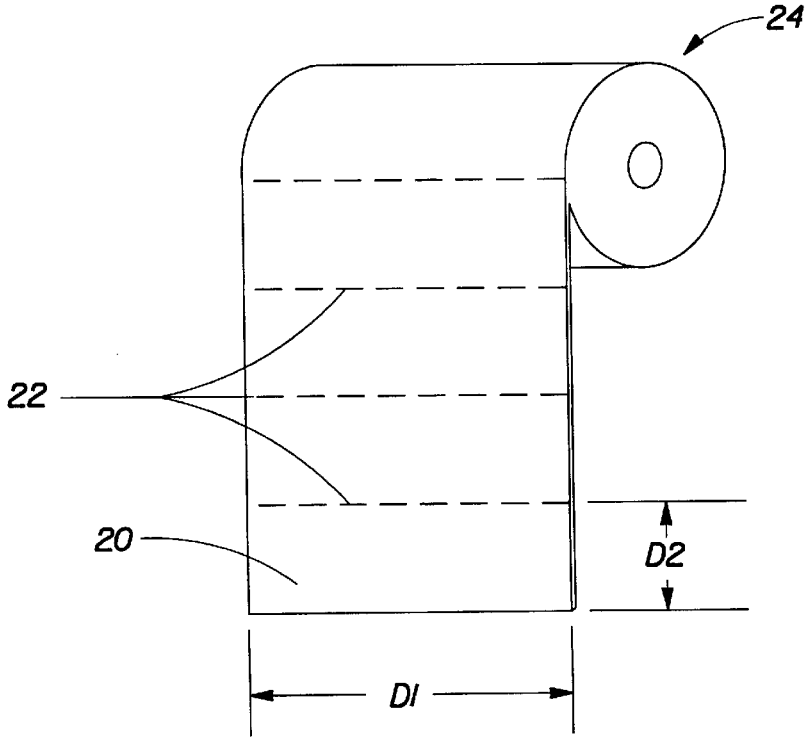
FIG. 3 is a perspective view of a plurality of sheets of the present invention core wound on a roll, each sheet being defined by consecutive perforations.

Sheet 20 can be made in wider widths than are currently commercially available for bath tissue. That is, sheets provided on a roll 24, as shown in FIG. 3, can have a dimension D1 parallel to the perforations 22 that is greater than those currently commercially available. For example, the dimension D1 of sheet 20 can be at least about 5 inches wide and more preferably 5.75 inches wide. Sheet 20 can also have a dimension D1 greater than about 6.5 inches, and more preferably 7.0 inches. Sheet 20 can also have a dimension D1 greater than about 8 inches, but it is believed that at widths (i.e., the lesser of two greater than about 9.0 inches the sheet becomes unwieldy and loses some effectiveness as a bath tissue. Sheet widths greater than about 10 inches are considered unsuitable for use as a bath tissue of the present invention.

As shown in FIG. 3, sheet 20 can be packaged on a roll 24, for example a core-wound roll, having a plurality of sheets, each sheet being defined by regularly spaced perforations 22. The perforations can be spaced at intervals providing convenient tear locations. Thus, the dimension D2 perpendicular to the perforations 22 can be predetermined for optimal paper usage. It has been found that by varying this dimension, consumers often use less paper due to the desire to conserve, and not take an additional sheet that may be perceived as being wasteful. Thus, the user can achieve a high level of cleanliness with hand protection with a minimum of sheets, in some cases only a single sheet. The perforations can be placed at intervals of about 4 inches, or can be placed at intervals of at least about 6 inches. In one embodiment, the interval between perforations was about 8 inches. It is believed that a dimension between perforations (i.e., dimension D2) greater than about 9 inches becomes less than optimal, as the implement becomes unwieldy in the hand of most users. Thus, dimensions D2 greater than about 10 inches are considered unsuitable for use as a bath tissue of the present invention. Perforations are preferably made according to the teachings of commonly assigned U.S. Pat. No. 5,114,771 issued May 19, 1992 to Ogg et al., and hereby incorporated herein by reference.

Alternatively, sheet 20 can be packaged in a stacked configuration, similar to methods currently used to package facial tissue. In a stacked configuration sheet 20 can be folded and interleaved. When provided in an appropriate tub, sheet 20 can be moistened and provided to the consumer as a premoistened bath tissue. Moisture can be water, or, alternatively, any of lotions commonly used in the art for wet wipes.

Whether stacked or on a roll, sheet 20 can have an area dimension optimized for a high degree of cleaning with hand protection. Thus, the area of sheet 20 can be about 30 $in^2$, and is more preferably at least about 40 $in^2$, more preferably at least about 60 $in^2$, more preferably at least about 65 $in^2$. It is currently believed that at areas greater than about 80 $in^2$, the sheet size becomes unwieldy in the hand of most users, and is thus less desirable. An area greater than about 90 $in^2$ is considered unsuitable for a wiping implement of the present invention.

The paper web can be made by methods known in the art. These methods include conventional paper making, through-air-dried paper making, and multiple basis weight paper making. In a preferred embodiment, the paper can be made using a resin coated forming belt, as depicted schematically in FIG. 2.

The preferred belt suitable for making the paper web of the present invention comprises two primary components: a framework and a reinforcing structure. The framework preferably comprises a cured polymeric photosensitive resin. The framework and belt have a first surface which defines the paper contacting side of the belt and an opposed second surface oriented towards the papermaking machine on which the belt is used.

The papermaking belt is macroscopically monoplanar. The plane of the papermaking belt defines its X-Y directions. Perpendicular to the X-Y directions and the plane of the papermaking belt is the Z-direction of the belt. Likewise, the paper according to the present invention can be thought of as macroscopically monoplanar and lying in an X-Y plane. Perpendicular to the X-Y directions and the plane of the paper is the Z-direction of the paper.

Preferably the framework defines a predetermined pattern, which imprints a like pattern onto the paper of the present invention. A particularly preferred pattern for the framework is an essentially continuous network. If the preferred essentially continuous network pattern is selected for the framework, discrete deflection conduits will extend between the first surface and the second surface of the belt. The essentially continuous network surrounds and defines the deflection conduits.

The framework prints a pattern corresponding to that of the framework onto the paper carried thereon. Imprinting occurs anytime the belt and paper pass between two rigid surfaces having a clearance sufficient to cause imprinting. This commonly occurs in a nip between two rolls. This most commonly occurs when the belt transfers the paper to a Yankee drying drum. Imprinting is caused by compression of the framework against the paper at the pressure roll.

The first surface of the belt contacts the paper carried thereon. During papermaking, the first surface of the belt may imprint a pattern onto the paper corresponding to the pattern of the framework.

The second surface of the belt is the machine contacting surface of the belt. The second surface may be made with a backside network having passageways therein which are distinct from the deflection conduits. The passageways provide irregularities in the texture of the backside of the second surface of the belt. The passageways allow for air leakage in the X-Y plane of the belt, which leakage does not necessarily flow in the Z-direction through the deflection conduits of the belt.

The second primary component of the belt is the reinforcing structure. The reinforcing structure, like the framework, has a first or paper facing side and a second or machine facing surface opposite the paper facing surface. The reinforcing structure is primarily disposed between the opposed surfaces of the belt and may have a surface coincident the backside of the belt. The reinforcing structure provides support for the framework. The reinforcing component is typically woven, as is well known in the art. The portions of the reinforcing structure registered with the deflection conduits prevent fibers used in papermaking from passing completely through the deflection conduits and thereby reduces the occurrences of pinholes. If one does not wish to use a woven fabric for the reinforcing structure, a nonwoven element, screen, net, or a plate having a plurality of holes therethrough may provide adequate strength and support for the framework of the present invention.

The belt may be made according to any of commonly assigned U.S. Pat. No. 4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; U.S. Pat. No. 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; U.S. Pat. No. 5,628,876 issued May 13, 1997 to Ayers et al.; U.S. Pat. No. 5,679,222 issued Oct. 21, 1997 to Rasch et al.; and U.S. Pat. No. 5,714,041 issued Feb. 3, 1998 to Ayers et al., the disclosures of which are incorporated herein by reference.

The paper of the present invention can have two primary regions. The first region can comprise an imprinted region which is imprinted against the framework of the belt. The imprinted region preferably comprises an essentially continuous network. The continuous network of the first region of the paper is made on the essentially continuous framework of the belt and will generally correspond thereto in geometry and be disposed very closely thereto in position during papermaking.

The second region of the paper can comprise a plurality of domes dispersed throughout the imprinted network region. The domes generally correspond in geometry, and during papermaking in position, to the deflection conduits in the belt. The domes protrude outwardly from the essentially continuous network region of the paper, by conforming to the deflection conduits during the papermaking process. By conforming to the deflection conduits during the papermaking process, the fibers in the domes are deflected in the Z-direction between the paper facing surface of the framework and the paper facing surface of the reinforcing structure. Preferably the domes are discrete.

Without being bound by theory, it is believed the domes and essentially continuous network regions of the paper may have generally equivalent basis weights. By deflecting the domes into the deflection conduits, the density of the domes is decreased relative to the density of the essentially continuous network region. Moreover, the essentially continuous network region (or other pattern as may be selected) may later be imprinted as, for example, against a Yankee drying drum. Such imprinting increases the density of the essentially continuous network region relative to that of the domes. The resulting paper may be later embossed as is well known in the art.

The paper according to the present invention may be made according to any of commonly assigned U.S. Pat. No. 4,529,480, issued Jul. 16, 1985 to Trokhan; U.S. Pat. No. 4,637,859, issued Jan. 20, 1987 to Trokhan; U.S. Pat. No. 5,364,504, issued Nov. 15, 1994 to Smurkoski et al.; and U.S. Pat. No. 5,529,664, issued Jun. 25, 1996 to Trokhan et al. and U.S. Pat. No. 5,679,222 issued Oct. 21, 1997 to Rasch et al., the disclosures of which are incorporated herein by reference.

If desired, the paper may be dried and made on a through-air drying belt not having a patterned framework. Such paper will have discrete, high density regions and an essentially continuous low density network. During or after drying, the paper may be subjected to a differential vacuum to increase its caliper and dedensify selected regions. Such paper, and the associated belt, may be made according to the following patents: U.S. Pat. No. 3,301,746, issued Jan. 31, 1967 to Sanford et al.; U.S. Pat. No. 3,905,863, issued Sep. 16, 1975 to Ayers; U.S. Pat. No. 3,974,025, issued Aug. 10, 1976 to Ayers; U.S. Pat. No. 4,191,609, issued Mar. 4, 1980 to Trokhan; U.S. Pat. No. 4,239,065, issued Dec. 16, 1980 to Trokhan; U.S. Pat. No. 5,366,785 issued Nov. 22, 1994 to Sawdai; and U.S. Pat. No. 5,520,778, issued May 28, 1996 to Sawdai, the disclosures of which are incorporated herein by reference.

In yet another embodiment, the reinforcing structure may be a felt, also referred to as a press felt as is used in conventional papermaking without through-air drying. The framework may be applied to the felt reinforcing structure as taught by commonly assigned U.S. Pat. No. 5,549,790, issued Aug. 27, 1996 to Phan; U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al., U.S. Pat. No. 5,795,440 issued Aug. 18, 1998 to Ampulski et al., U.S. Pat. No. 5,814,190 issued Sep. 29, 1998 to Phan; U.S. Pat. No. 5,817,377 issued Oct. 6, 1998 to Trokhan et al.; and U.S. Pat. No. 5,846,379 issued Dec. 8, 1998 to Ampulski et al., the disclosures of which are incorporated herein by reference.

The paper may also be foreshortened, as is known in the art. Foreshortening can be accomplished by creping the paper from a rigid surface, and preferably from a cylinder. A Yankee drying drum is commonly used for this purpose. Creping is accomplished with a doctor blade as is well known in the art. Creping may be accomplished according to commonly assigned U.S. Pat. No. 4,919,756, issued Apr. 24, 1992 to Sawdai, the disclosure of which is incorporated herein by reference. Alternatively or additionally, foreshortening may be accomplished via wet microcontraction as taught in commonly assigned U.S. Pat. No. 4,440,597, issued Apr. 3, 1984 to Wells et al., the disclosure of which is incorporated herein by reference.

If desired, the paper may have multiple basis weights. Preferably the multiple basis weight paper has two or more distinguishable regions: regions with a relatively high basis weight, and regions with a relatively low basis weight. Preferably the high basis weight regions comprise an essentially continuous network. The low basis weight regions may be discrete. If desired, the paper according to present invention may also comprise intermediate basis weight regions disposed within the low basis weight regions. Such paper may be made according to commonly assigned U.S. Pat. No. 5,245,025, issued Sep. 14, 1993 to Trokhan et al., the disclosure of which is incorporated herein by reference. If the paper has only two different basis weight regions, an essentially continuous high basis weight region, with discrete low basis weight regions disposed throughout the essentially continuous high basis weight region, such paper may be made according to commonly assigned U.S. Pat. No. 5,527,428 issued Jun. 18, 1996 to Trokhan et al.; U.S. Pat. No. 5,534,326 issued Jul. 9, 1996 to Trokhan et al.; and U.S. Pat. No. 5,654,076, issued Aug. 5, 1997 to Trokhan et al., the disclosures of which are incorporated herein by reference.

One may further wish to density selected regions of the paper. Such paper will have both multiple density regions and multiple basis weight regions. Such paper may be made according to commonly assigned U.S. Pat. No. 5,277,761, issued Jan. 11, 1994 to Phan et al.; U.S. Pat. No. 5,443,691, issued Aug. 22, 1995 to Phan et al., and U.S. Pat. No. 5,804,036 issued Sep. 8, 1998 to Phan et al., the disclosures of which are incorporated herein by reference.

The papermaking belt used to make the paper of the present invention may comprise a plurality of protuberances. The protuberances are upstanding from the plane of the papermaking belt and are preferably discrete. The protuberances obturate drainage through selected regions of the papermaking belt, producing low and high basis weight regions in the paper, respectively. The papermaking belt for use with the present invention may be made according to commonly assigned U.S. Pat. No. 5,503,715, issued Apr. 2, 1996 to Trokhan et al.; U.S. Pat. No. 5,614,061, issued Mar. 25, 1997 to Phan et al.; U.S. Pat. No. 5,804,281 issued Sep. 8, 1998 to Phan et al., and U.S. Pat. No. 5,820,730, issued Oct. 13, 1998 to Phan et al., the disclosures of which are incorporated herein by reference.

If desired, in place of a belt having the patterned framework described above, a belt having a jacquard weave may be utilized. Such a belt may be utilized as a forming wire, drying fabric, imprinting fabric, transfer clothing etc. A jacquard weave is reported in the literature to be particularly useful where one does not wish to compress or imprint the paper in a nip, such as typically occurs upon transfer to a Yankee drying drum. Illustrative belts having a jacquard weave are found in U.S. Pat. No. 5,429,686 issued Jul. 4, 1995 to Chiu et al. and U.S. Pat. No. 5,672,248 issued Sep. 30, 1997 to Wendt et al.

The paper according to the present invention may be layered. If the paper is layered, a multi-channel headbox may be utilized as is known in the art. Such a headbox may have two, three, or more channels. Each channel may be provided with a different cellulosic fibrous slurry. Optionally, the same slurry may be provided in two or more of the channels. However, one of ordinary skill will recognize that if all channels contain the same furnish a blended paper will result.

Typically, the paper is layered so that shorter hardwood fibers are on the outside to provide a soft tactile sensation to the user. Longer softwood fibers are on the inside for strength. Thus, a three-channel headbox may produce a single-ply product, having two outer plies comprising predominantly hardwood fibers and a central ply comprising predominantly hardwood fibers.

Alternatively, a two-channel headbox may produce a paper having one ply of predominantly softwood fibers and one ply of predominantly hardwood fibers. Such a paper is joined to another ply of a like paper, so that the softwood layers of the resulting two-ply laminate are inwardly oriented toward each other and the hardwood layers are outwardly facing.

In an alternative manufacturing technique, multiple headboxes may be utilized in place of a single headbox having multiple channels. In the multiple headbox arrangement, the first headbox deposits a discrete layer of cellulosic fibers onto the forming wire. The second headbox deposits a second layer of cellulosic fibers onto the first. While, of course, some intermingling between the layers occurs, a predominantly layered paper results.

Layered paper of constant basis weight may be made according to the teachings of commonly assigned U.S. Pat. No. 3,994,771, issued Nov. 30, 1976 to Morgan, Jr. et al.; U.S. Pat. No. 4,225,382, issued Sep. 30, 1980 to Kearney et al.; and U.S. Pat. No. 4,300,981, issued Nov. 17, 1981 to Carstens, the disclosures of which are incorporated herein by reference.

What is claimed is:

1. A bath tissue formed into sheets, each sheet comprising:

(a) at least one ply of cellulosic paper;

(b) a basis weight of at least about 25 lb/3000 square feet;

(c) a width of about 5.75 inches to about 9 inches;

(d) an area of at least about 30 square inches; and (e) temporary wet tensile strength properties, wherein said tissue is premoistened.

2. A bath tissue according to claim 1, wherein said bath tissue is premoistened with a lotion.

* * * * *

UNITED STATES PATENT AND TRADEMARK OFFICE

CERTIFICATE OF CORRECTION

PATENT NO. : 6,458,450 B1 
DATED : October 1, 2002
INVENTOR(S) : Mark John Steinhardt et al.

It is certified that error appears in the above-identified patent and that said Letters Patent is hereby corrected as shown below:

Column 14,
Line 43, “desity” should read -- densify --.

Signed and Sealed this

Twenty-second Day of April, 2003

JAMES E. ROGAN
*Director of the United States Patent and Trademark Office*